United States Patent [19]

Sosa

[11] Patent Number: 4,572,400

[45] Date of Patent: Feb. 25, 1986

[54] STORAGE RECEPTACLE

[76] Inventor: Hector M. Sosa, 7311 SW. 132 Ave., Miami, Fla. 33183

[21] Appl. No.: 646,108

[22] Filed: Aug. 31, 1984

[51] Int. Cl.[4] ..... B65D 45/28

[52] U.S. Cl. ..... 220/323; 220/1 T; 220/336

[58] Field of Search ..... 220/1 T, 336, 323

[56] References Cited

U.S. PATENT DOCUMENTS 4,450,974 5/1984 Winden ..... 220/336

*Primary Examiner*—George T. Hall

*Attorney, Agent, or Firm*—Ernest H. Schmidt

[57] ABSTRACT

A storage receptacle for the collection of trash, litter, garbage, etc., particularly in public places such as recreational grounds and picnic areas, is fabricated of formed concrete for strength and stability, and has a cantilevered closure lid, normally locked in closed, covering relation, but which may be unlocked and readily swung between open and closed positions by an attendant whenever necessary for emptying. Side openings just below the lid serve as access to the receptacle for disposal use by the public.

7 Claims, 17 Drawing Figures

STORAGE RECEPTACLE

This invention relates to storage receptacles and is directed particularly to storage receptacles of the type suitable for use by the public for the disposal of litter, empty bottles, cans and the like, including garbage. As such, it is particularly well suited for use in public parks and picnic areas, as well as being suitable for household or apartment use in the collection for temporary storage of trash and garbage.

Trash and garbage receptacles commonly used at recreational grounds and picnic areas are fabricated of sheet metal or heavy plastic materials, and are either without lids, or have lids that are of such light-weight construction that they are readily dislodged or damaged in use. As such, they permit the entrance of rain water. Trash and garbage, thus water logged, makes the job of emptying and cleaning the receptacles difficult and unpleasant. Such plastic and sheet metal refuse receptacles or containers, because of their comparative light weight, can easily be upset by careless individuals, further adding to the difficulties of maintenance personnel. Such light weight and readily uncovered containers, moreover, are often upset and raided by dogs and wild animals foraging for food, further adding to the difficulties encountered in maintenance.

It is, accordingly, the principal object of this invention to provide a novel and improved refuse storage receptacle that obviates the above described deficiencies of waste, litter or refuse storage receptacles heretofore devised.

A more particular object is to provide a storage receptacle of the character described that can readily be fabricated of formed concrete and which has a heavy lid that is normally locked in closed, covering position, the receptacle having a plurality of side openings near the upper end just below the lid through which refuse can be passed for deposit into a light-weight auxiliary container within the receptacle.

Another object of the invention is to provide a storage receptacle of the above nature the covering lid of which an attendant can readily and easily unlock and open for emptying, with or without use of a special key.

Still another object of the invention is to provide a storage or refuse receptacle that is so heavy that it cannot be readily upset or opened by members of the public or by large animals, and which, for added security, can be partially buried in the ground and therefore, at the same time, being less con- spicuous.

Other objects, features and advantages of the invention will be apparent from the following description when read with reference to the accompanying drawings.

In the drawings, wherein like reference numerals denote corresponding parts throughout the several views.

Figure 1:
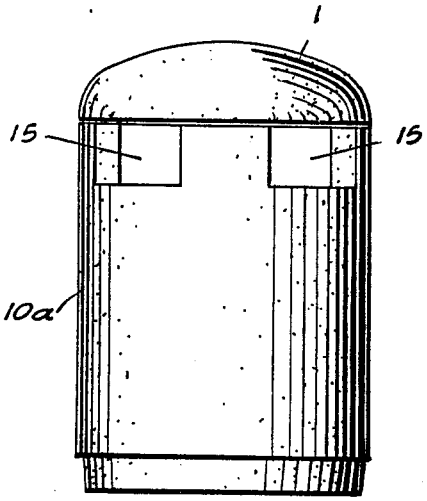
FIG. 1 is a side elevational view of a preferred form of storage receptacle or container embodying the invention.
Figure 2:
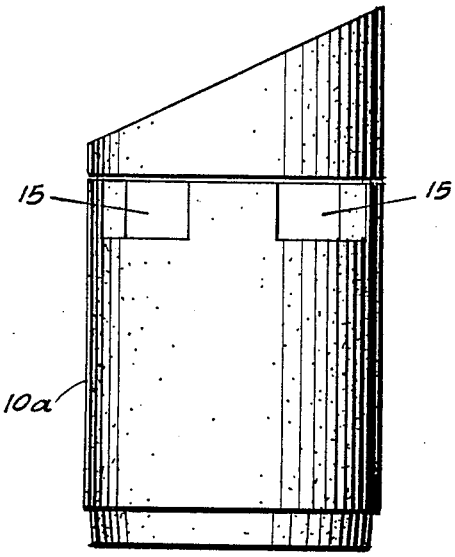
FIG. 2 is a side elevational view similar to that of FIG. 1, but illustrating an alternate form of the invention wherein the top surface of the cover defines an inclined plane rather than a symmetrically rounded dome.
Figure 4:
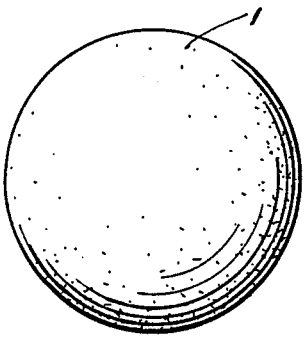
FIG. 4 is a plan view of the storage receptacle as illustrated in FIG. 1.
Figure 3:
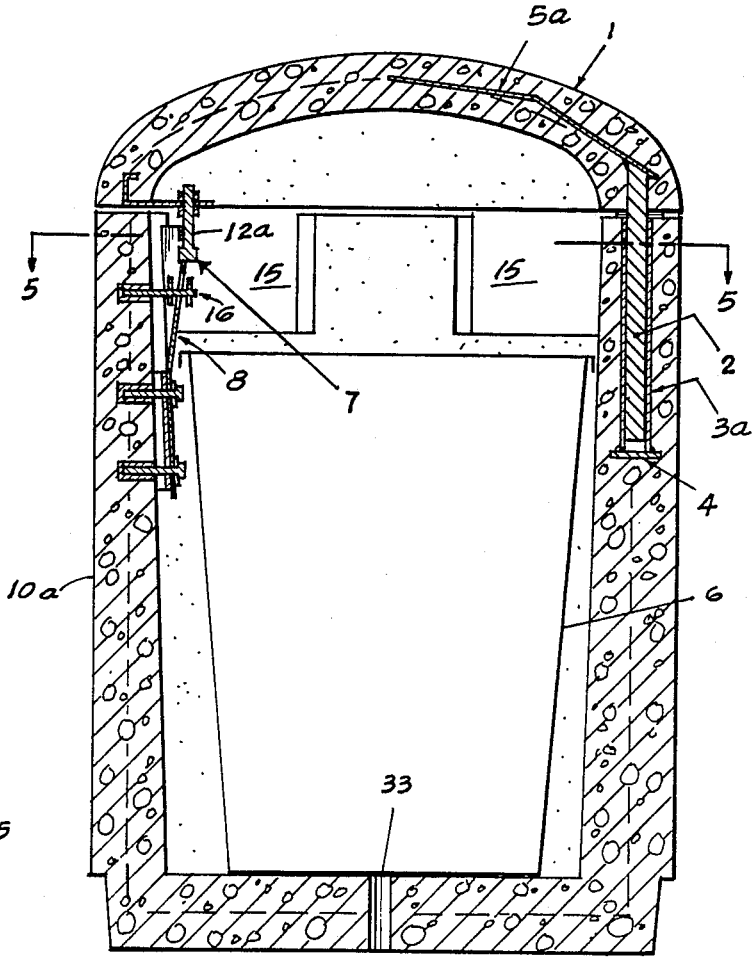
FIG. 3 is a vertical cross-section of the storage receptacle illustrated in FIG. 1, taken along the plane indicated at 3—3 of FIG. 5 in the direction of the arrows.
Figure 5:
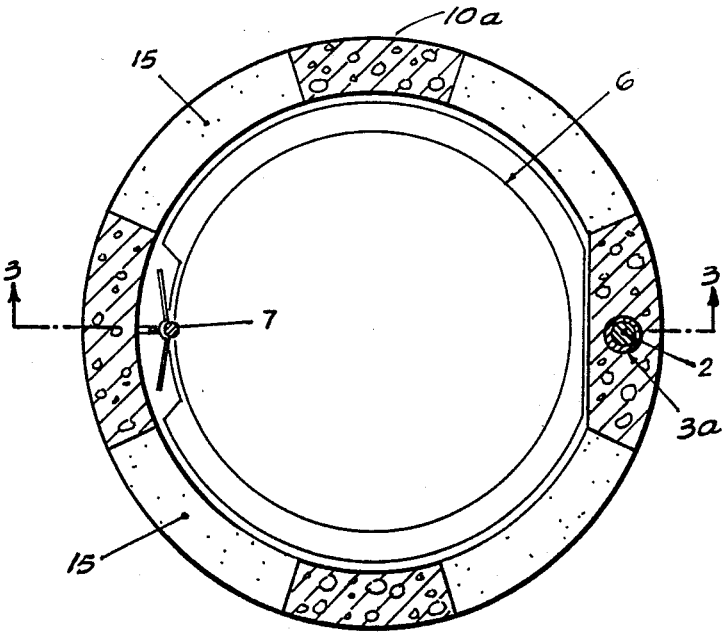
FIG. 5 is a transverse cross-sectional view of the storage receptacle illustrated in FIG. 3, taken along the line 5—5 the direction of the arrows.
Figure 6:
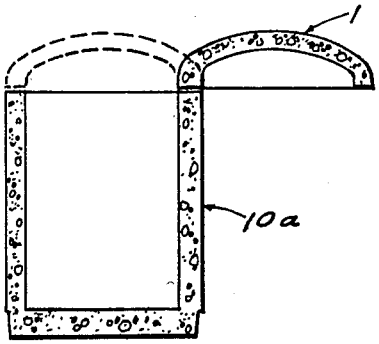
FIG. 6 is a vertical cross-section, on a reduced scale, of the embodiment of the invention illustrated in FIG. 1, with the cap or cover shown in open position, normal closed position being illustrated in broken lines.
Figure 7:
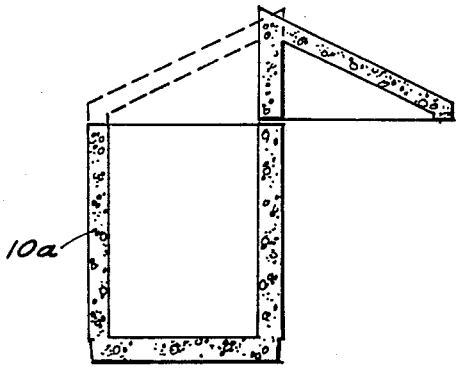
FIG. 7 is a vertical cross-section, on a reduced scale, of the embodiment of the invention illustrated in FIG. 2, with the cap or cover shown in open position, normal closed position being illustrated in broken lines.

Referring now in detail to the drawings and considering first the embodiment of the invention illustrated in FIGS. 1, 3 and 6, the same comprises, generally, a cylindrical container 10*a*, which is preferably fabricated of formed concrete, and a dome cap 1, also of formed concrete and having embedded therein. one end of a steel shaft 2, received within a steel sleeve 3*a* embedded within the cylindrical container 10*a* and opening into the top annular rim thereof. The bottom end of the sleeve 3*a* has welded thereagainst a closure plate 4. The upper, cap-embedded end of the steel shaft 2 is welded to a flat steel bar 5*a* embedded within the upper portion of the cap 1 to provide for strengthening and to securely anchor the steel shaft. The shaft and sleeve assembly 2, 3*a*, serves to hinge the receptacle cap 1 so that it can be swung or rotated 180 degrees, in cantilevered position as illustrated in FIG. 6, leaving the receptacle completely open for access to a litter container 6, for example, which may be placed in the receptacle for receiving refuse. For this purpose, the upper end of the cylindrical container 10*a* is formed with four equidistantly-spaced through openings or ports 15 large enough to permit the manual insertion of ordinary refuse and litter to be disposed of at public recreational areas, campsites, public picnic grounds and the like.

Figure 8:
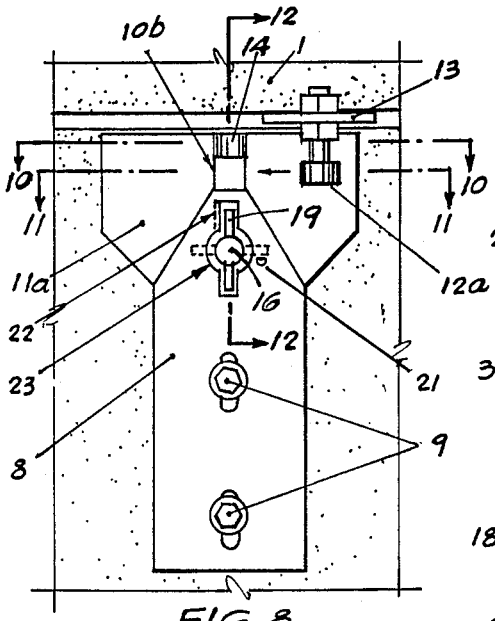
FIG. 8 is front elevational view of the cap or cover locking mechanism.
Figure 9:
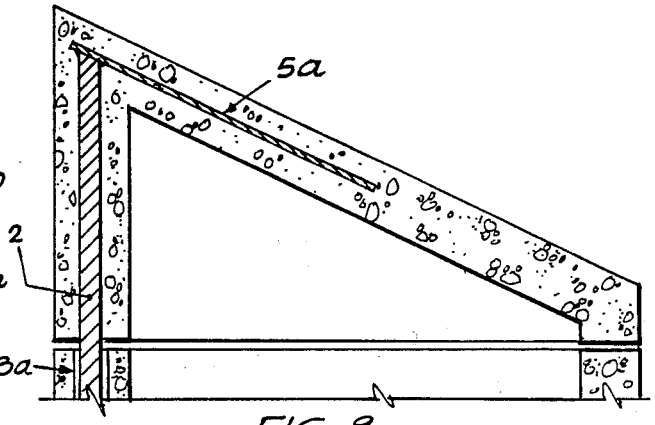
FIG. 9 is a vertical cross-sectional view of a top portion of the embodiment of the invention illustrated in FIG. 2, illustrating the pivotal hinge mechanism permitting opening and closing of the container cap.
Figure 10:
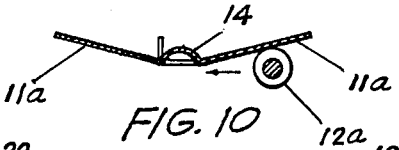
FIG. 10 is a transverse cross-sectional view of the cap locking mechanism, taken along the line 10—10 of FIG. 8 in the direction of the arrows.
Figure 11:
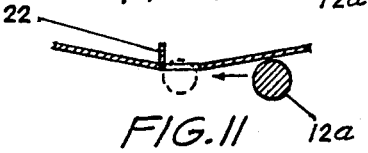
FIG. 11 is a transverse cross-sectional view of the cap locking mechanism, taken along the line 11—11 of FIG. 8 in the direction of the arrows.

Mechanism is provided for slamming the cap 1 closed in the manner of an ordinary door upon being turned from the open position, represented by the full-line illustration thereof in FIG. 6, to the position illustrated in broken lines. To this end, a latch assembly, generally indicated by reference numeral 7 in FIG. 3, is provided. FIG. 8 is a front elevational view of the latch assembly 7, which comprises a spring quality metal plate 8 anchored to the inside container wall with the use of bolts 9. The metal plate 8 is formed near the upper end with a rectangular slot 10*b* and two opposed, inclined plane portions 11*a*, 11*a*, extending outwardly of the slot 10 (See FIG. 10). As the container closure cap 1 rotates to a closed position, a socket head type bolt 12 secured to a plate 13 embedded in the concrete cap moves toward the slot 10*b*, as indicated by the arrow in FIGS. 8, 10 and 11, pushing against the adjacent inclined plane portion 11*a* of the resilient plate 8 until said bolt head reaches the slot 10*b*, whereat it snaps into a rest position, keeping the cap 1 closed. In this connection it is to be noted that when in closed position, the shaft or shank of bolt 12*a* is received within an arcuate recess 14, formed in the metal plate 8 immediately above the rectangular slot 10*b*.

To open the cap 1, the attendant will introduce his hand through one of the ports 15 adjacent to the latch and push the upper portion of the resilient plate 8 towards the inner wall of the container, thereby releasing the bolt 12*a* to permit rotation of the closure cap 1 to the open position again. It will be noted that, in opening and closing the receptacle cap, the downwardly projecting bolt 12*a* passes freely through either of the ports 15 on each side of the latch mechanism.

Figure 12:
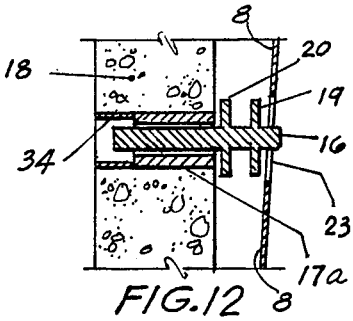
FIG. 12 is a vertical cross-sectional view taken along the line 12—12 of FIG. 8 in the direction of the arrows and illustrating details of the cap locking mechanism.
Figure 13:
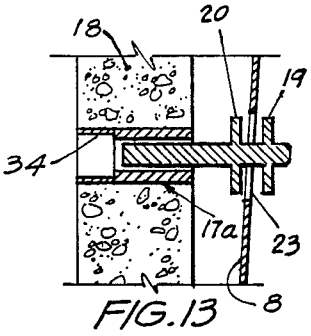
FIG. 13 is a vertical cross-sectional view similar to that of FIG. 12, but showing the locking bolt in a different position.

Means is also provided for locking the container cap in the closed position. As illustrated in FIGS. 8, 12 and 13, the locking device comprises a screw bolt 16, the threaded end of which is received within an internally-threaded jacket or sleeve 17*a*, cast in the sidewall of cylindrical container 10*a*, that wall portion thereof being indicated by reference numeral 18 in FIG. 12.

The bolt 16 is provided with a pair of diametrically-extending, longitudinally-spaced, outer and inner cross pins 19 and 20, respectively. These pins, which lie in a common plane, fit through a keyhole shaped slot 23 provided in the resilient metal plate 8. When in unlocked position, two modes of operation are provided for. FIG. 13 illustrates the hand locking mode. In this mode the attendant introduces his hand through an adjacent side port 15 and turns pin 19 until it hits a small stop 21 punched out of the upper wall of plate 8, (see FIG. 8.). This turning movement also rotates the inner pin 20, preventing inward movement of the plate toward the inner container wall, and therefore preventing opening of the container in the manner described herein above. To unlock the closure cap 1, pin 19 must be turned 90 circular degrees to the left until it abutts a punched-out protrusion 22 of the keyhole slot 23, thereby allowing the plate to be pushed, and releasing the bolt 12*a*.

Figure 14:
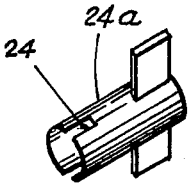
FIG. 14 is an oblique view of the locking key suitable for locking and unlocking container cap from the inside of the container.

FIG. 12 illustrates the locking device in the key operated mode. In this mode, a special tubular key 24*a* (See FIG. 14) has to be introduced by the attendant through either one of the side ports 15 and fitted through the keyhole slot 23, whereupon it can be fitted over the bolt 16 so that pin 19 fits through and seats within diametrically opposed slots 24 in said key. The bolt can then be turned 90 degrees one way or another, as described above for the hand operated mode.

To change from one mode of operation to another, the plate 8 is pulled away from the interior wall of the container and pin 16 is rotated several turns in its threaded jacket 17*a* as required to position it in one or the other of the modes illustrated in FIGS. 12 and 13. As illustrated in FIG. 13, cross pin 20 does the locking and pin 19 acts as a hand operated knob.

Figure 15:
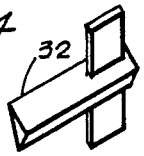
FIG. 15 is an oblique view of a special key for locking and unlocking the container from the outside.

Means is also provided for locking and unlocking the storage receptacle or container 10*a* from the outside by an attendant having a special key. To this end, as illustrated in FIGS. 12 and 13, the cylindrical opening 34 in the sidewall of the receptacle in which the sleeve 17*a* is received, optionally can be extended through to the outside of the container to permit insertion of a key 32 (See FIG. 15). The shaft of the key 32 will preferably be of a special cross-sectional shape, triangular, for example, as is illustrated, to fit over or within a corresponding, complimental end portion of the pin 16. Pin 16 can thus be turned between locking and unlocking positions by an attendant inserting the special key 32 from the outside.

Figure 16:
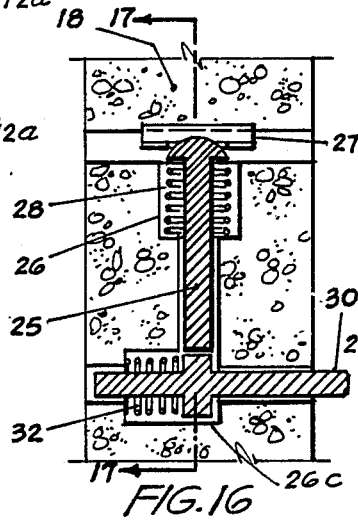
FIG. 16 is a partial, vertical cross-section, taken through the wall of the container and its cap, illustrating an alternate locking mechanism.

FIG. 16, being a partial vertical section through the wall of the cylindrical container 10*a* and its cap 1 at a position diametrically opposite the pivotal shaft 2, illustrates an alternate locking mechanism, which, for the most part, fits within the container wall and does not protrude into the receptacle. This embodiment comprises a carrier bolt 25 which slides up and down in a cylindrical opening or recess 26. A metal plate 27, fixed with respect to the underside of the container cap 1, forms opposed inclined planes 27*a*, 27*b*, extending from each side of a central, round opening 29. Upon closure of the cap 1, the plate 27 pushes the bolt 25 downwardly against the upward urging of circumjacent compression spring 28 that is constrained between the underside of the rounded head of the carrier bolt 25, and an annular bottom seat portion of the recess 26. The diameter of the round opening 29 is slightly smaller than the diameter of the carrier bolt head, so that when the container cap 1 moves to closed position, the bolt head snaps in position within the opening to retain the cap in closed position. The cap can then be opened by pushing it to one side or the other because of the shallow angle of the bolt head with respect to the round opening 29 in the plate 27.

Figure 17:
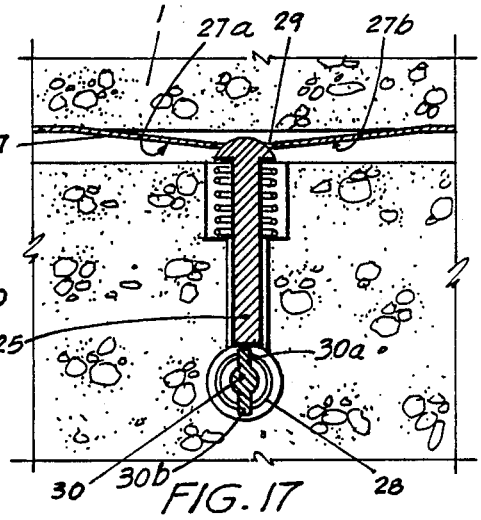
FIG. 17 is a vertical cross-section, taken along the lines 17—17 of FIG. 16 in the direction of the arrows.

Means is also provided for securely locking the abovedescribed locking mechanism of FIGS. 16 and 17, so that it can be opened only by an attendant. To this end, as illustrated in FIGS. 16 and 17, a laterally-extending locking bolt 30 is provided at the lower end of the carrier bolt 25, said locking bolt having a pair of diametrically-opposed projections, 30*a* and 30*b*. The bolt 30 can be made long enough to protrude inside of the cylindrical container 10*a*, as illustrated in FIG. 16, permitting an attendant to turn it by hand to position the protrusions 30*a*, 30*b* to extend vertically, so that downward movement of the carrier bolt 25 is abuttingly blocked and cannot be depressed by the inclined plate 27 to prevent sideward opening swinging of the cap 1, (See FIGS. 16 and 17). The lock can be deactivated either by hand, as described above, or by a key from the outside or inside to turn the locking bolt 30 so that its protrusions extend horizontally, thereby allowing the carrier bolt to be depressed and the cap 1 to be released.

Reference numeral 32 in FIG. 16 illustrates a compression spring, circumjacent the bolt 30 and constrained between outer edge portions of the bolt projections 30*a*, 30*b* and an annular wall portion of the cylindrical opening 26*c*, within which said bolt is received. Introducing the hand through one of the adjacent side ports 15 permits an attendant to push inwardly upon the inwardly-extending end of the locking bolt 30, thus compressing spring 32 and displacing abutment flap 30*a* out of the way of carrier bolt 25, allowing it to be depressed in release of the cap 1, as described above.

Reference numeral 33 in FIG. 3 illustrates a drain hole at the bottom of the receptacle or container for discharge of rain or other liquids.

While I have illustrated and described herein only two basic forms in which my invention can conveniently be embodied in practice, it is to be understood that these embodiments are presented by way of example only and not in a limiting sense. The invention, in brief, comprises all the embodiments and modifications coming within the scope and spirit of the following claims.

What I claim as new and desire to secure by Letters Patent is:

1. A storage receptacle comprising, in combination, an open-top container, a closure lid for said container, means pivotally supporting said lid with respect to said container so that it is can be moved sidewardly in cantilevered relation between open and closed positions with respect to said container, and means for releaseably locking said lid in closed position upon said container, said container being cylindrical in shape and said closure lid being circular in shape, said container and said closure lid both being fabricated of formed concrete, said pivotally supporting means comprising a steel shaft embedded in and extending outwardly of the rim of said circular lid, a tubular sleeve imbedded within the rim at the open-top end of said cylindrical container, said shaft being journalled in said sleeve for rotative motion therein, said releaseably locking means comprising a resilient member secured to the inside wall of said container, and a bolt member secured with respect to and extending downwardly and outwardly of the rim of said circular lid, said bolt member having a head portion receivable end and an opening in said resilient member for interlocking said bolt and said resilient member, said resilient member further being formed with opposed, inclined-plane portions, said inclined-plane portions and said bolt head portion being so relatively positioned that when said lid is moved between open and closed positions said bolt head portion will slide against one or the other of said opposed inclined-plane portions to cam said resilient member away from said bolt head member until said bolt head member is received within said opening in said resilient member.

2. A storage receptacle as defined in claim 1 wherein the sidewall of said container, at the upper end, is provided with a through opening extending into said upper end.

3. A storage receptacle as defined in claim 1 wherein the sidewall of said container is provided with a plurality of pheripherally-spaced through openings extending into the upper end of said container.

4. A storage receptacle as defined in claim 3 including means limiting the resilient movement of said resilient member and thereby locking said lid in place.

5. A storage receptacle as defined in claim 4 wherein said resilient movement limiting means comprises a rotary member having a relatively fixed abutment portion moveable in and out of abutting position with respect to said resilient member.

6. A storage receptacle as defined in claim 1 wherein said releaseably locking means further comprises a metal plate member fixed with respect to the underside of said circular lid, said plate member being formed with opposed inclined-plane portions extending outwardly of the central round opening, and a bolt member having a rounded head and being vertically received for reciprocative sliding motion within a cylindrical opening in the peripheral sidewall of said container, resilient means normally urging said bolt in the outward direction with respect to said container rim, said inclined-plane portions and said bolt head being so relatively positioned that when said lid is moved between open and closed positions, said bolt head will slide against one or the other of said opposed inclined-plane portions to cam said bolt member away from said plate member until said bolt head member is in position to seat within said circular opening as urged by said resilient means.

7. A storage receptacle as defined in claim 6 including abutment means limiting the reciprocative movement of said bolt and thereby locking said lid in place.

* * * * *